US006051829A

United States Patent [19]

Full

[11] Patent Number: 6,051,829

[45] Date of Patent: Apr. 18, 2000

[54] SAFETY DETECTION SYSTEM FOR SLIDING DOORS

[75] Inventor: Gary G. Full, Tucson, Ariz.

[73] Assignee: Otis Elevator Company, Farmington, Conn.

[21] Appl. No.: 08/879,676

[22] Filed: Jun. 23, 1997

[51] Int. Cl.[7] ..... B66B 13/26; E05F 15/20

[52] U.S. Cl. ..... 250/221; 250/216; 49/25; 49/26; 187/317; 187/392

[58] Field of Search ..... 250/221, 222.1, 250/216; 49/25, 26, 27, 28, 31; 187/317, 391, 392, 393

[56] References Cited

U.S. PATENT DOCUMENTS

| | | | |
|---|---|---|---|
| Re. 30,719 | 8/1981 | Mills | 187/52 R |
| 3,852,592 | 12/1974 | Scoville et al. | 250/221 |
| 4,029,176 | 6/1977 | Mills | 187/52 R |
| 4,894,952 | 1/1990 | Trett et al. | 49/25 |
| 4,976,337 | 12/1990 | Trett | 49/31 |
| 5,040,331 | 8/1991 | Merendino et al. | 49/25 |
| 5,142,152 | 8/1992 | Boiucaner | 250/341 |
| 5,428,923 | 7/1995 | Waggamon | 49/28 |
| 5,886,307 | 3/1999 | Full et al. | 187/317 |
| 5,925,858 | 7/1999 | Full et al. | 187/317 |

FOREIGN PATENT DOCUMENTS

| | | |
|---|---|---|
| 0522478A2 | 1/1993 | European Pat. Off. . |
| 699619A2 | 3/1996 | European Pat. Off. . |
| 0710761A1 | 5/1996 | European Pat. Off. . |
| 2144873A | 3/1985 | United Kingdom . |

*Primary Examiner*—John R. Lee

[57] ABSTRACT

A safety system for detecting an obstruction approaching closing doors includes a transmitter stack and a detector stack. Each transmitter stack includes a plurality of transmitter three-dimensional lenses. Each detector stack includes a plurality of detector three-dimensional lenses. The three-dimensional lenses are offset from the corresponding optical devices to angle an outgoing or incoming signal. The present invention results in more compact packaging for the safety system and in reduced cost of the assembly therefor.

9 Claims, 2 Drawing Sheets

SAFETY DETECTION SYSTEM FOR SLIDING DOORS

CROSS-REFERENCE TO RELATED APPLICATIONS

This application is related to commonly owned U.S. Pat. Nos. 5,886,307 and 5,925,858.

TECHNICAL FIELD

The present invention relates to door systems and, more particularly, to safety detection systems therefor.

BACKGROUND OF THE INVENTION

Many automatic sliding doors are equipped with safety systems intended to detect potential interference with the closing operation of the doors. These safety systems usually include a plurality of signal sources, disposed on one door, and a plurality of receivers, disposed on the other door. The signal sources emit a curtain of signals across the threshold of the door to be detected by the plurality of receivers. When the signal curtain is interrupted, the safety system communicates with a door controller either to cease the closing operation and open the doors or to maintain the doors open, depending on the initial position of the doors.

A doorway safety system described in U.S. Pat. No. 4,029,176 to Gerald W. Mills and entitled "Doorway Safety Device" uses acoustic wave transmitters and receivers to detect endangered objects or persons. Not only does the patented system detects objects positioned between the doors and across the threshold, but it also extends the zone of detection into the entryway. The transmitters send out a signal at an angle into the entryway. When an obstruction enters the detection zone, the signal reflects from the obstruction and is detected by the receivers.

Similarly, a published European Patent Application No. EP 0699619A2 to Memco Limited and entitled "Lift Installation for Preventing Premature Closure of the Sliding Doors" describes a three-dimensional system for detecting objects or persons not only across the threshold, but also in the entryway.

For the three-dimensional detection system to work properly, the signal must be emitted into an entryway at a specific angle. Conventional technology uses optical devices that protrude from a circuit board. To obtain a particular angle, a lead of the optical device protruding from the circuit board must be bent. To ensure uniformity among multiple optical devices, a plastic holder is often used to maintain the optical device at a specific angle. This conventional approach is labor intensive and therefore, expensive. Additionally, the plastic holder has a certain thickness which results in a greater space requirement. Furthermore, the bent leads of the optical device typically cause reliability problems.

Modern surface mount technology is available and generally results in smaller packaging, less labor, and thus, lower cost. However, surface mount optical devices currently available, such as LEDs (light emitting devices) and photodiodes, typically do not include a lens. Also the existing surface mount technology does not include optical devices providing a signal at an angle.

DISCLOSURE OF THE INVENTION

It is an object of the present invention to improve a safety detection system for sliding doors.

According to the present invention, a safety system for detecting an obstruction approaching closing doors includes a transmitter stack and a detector stack with each transmitter three-dimensional lens in the transmitter stack being offset from a transmitter optical device to bend a signal emitted by the optical device. The detector three-dimensional lenses are also offset from the detector optical device to receive a signal at various angles.

One feature of the present invention is that the transmitter lenses and the detector lenses are formed as part of a transmitter lens board and a detector lens board, respectively. Such packaging reduces labor costs and reduces space requirements. Another feature of the present invention is that the lens board is self-positioning. The lens board includes tabs protruding therefrom and fitting into openings within the circuit board. This ensures proper positioning of the lenses with respect to the optical devices.

One major advantage of the present invention is that the packaging is compact and reduces space requirements for the safety system. Another advantage of the present invention is increased reliability resulting from eliminating bent leads and optical device holders.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
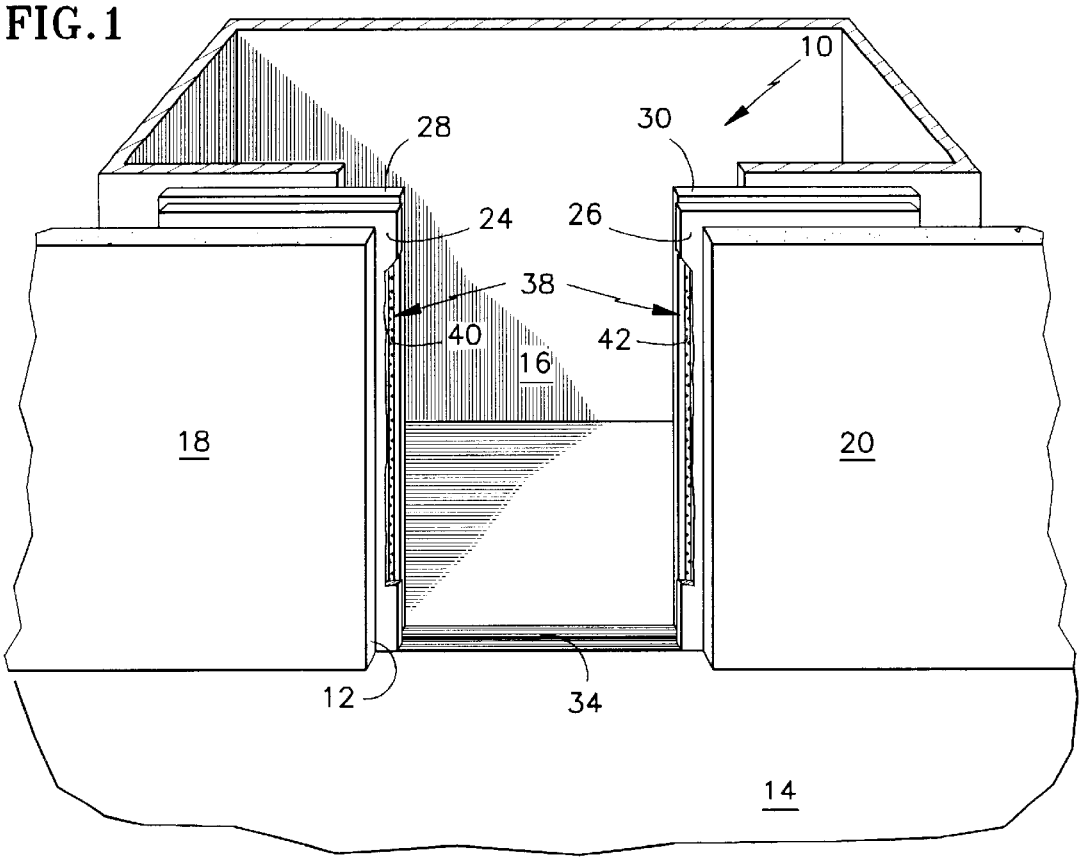
FIG. 1 is a schematic, partially cut-away, perspective view of a door system with a safety detection system mounted thereon, according to the present invention.

Referring to FIG. 1, a door system 10 for opening and closing a doorway 12 from a hallway 14 into an elevator cabin 16 is adjacent to walls 18, 20 and includes a set of hallway doors 24, 26 and a set of elevator cab doors 28, 30. Both sets of doors 24, 26, 28, 30 slide open and closed in unison across a threshold 34 with the hallway set of doors 24, 26 closing and opening slightly ahead and behind of the cab doors, 28, 30 respectively.

A safety detection door system 38 is disposed on the cab doors 28, 30 adjacent to the hallway doors 24, 26. The safety door system 38 includes a transmitter stack 40 and a detector stack 42, each disposed on opposite sides of the doorway 12 and facing each other.

Figure 2:
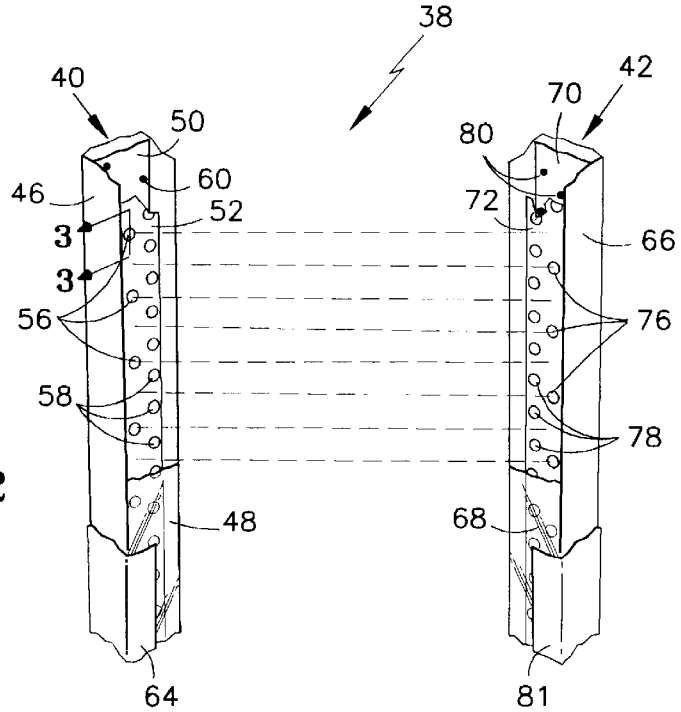
FIG. 2 is a schematic, cut-away, perspective view of a transmitter stack and a detector stack of the safety detection system of FIG. 1.

Referring to FIG. 2, each transmitter stack 40 includes a housing 46 and a transparent cover 48 for protecting a transmitter circuit board 50 and a transmitter lens board 52. The transmitter lens board 52 includes a plurality of transmitter three-dimensional lenses 56 and a plurality of transmitter curtain lenses 58. The transmitter circuit board 50 includes a plurality of transmitters or LEDs (light emitting devices) 60 disposed adjacent to each lens 56, 58 for emitting infrared light. A transmitter barrier 64 supports the housing 46 and partially blocks light for the transmitter three-dimensional lenses 56.

The detector stack 42 is structured as a mirror image of the transmitter stack 40. The detector stack 42 includes a detector stack housing 66 with a transparent detector stack cover 68 for protecting a detector circuit board 70 and a detector lens board 72. The detector lens board 72 includes a plurality of detector three-dimensional lenses 76 and a plurality of detector curtain lenses 78 formed therein. The detector curtain lenses 78 are disposed directly across from the transmitter curtain lenses 58. The detector three-dimensional lenses 76 are vertically staggered from the transmitter three-dimensional lenses 56. The detector circuit board 70 includes a plurality of detectors or photodiodes 80 adjacent to each lens 76, 78 for detecting reflected light. A detector barrier 81 supports the detector housing 66 and partially blocks light for the detector three-dimensional lenses 76.

Figure 3:
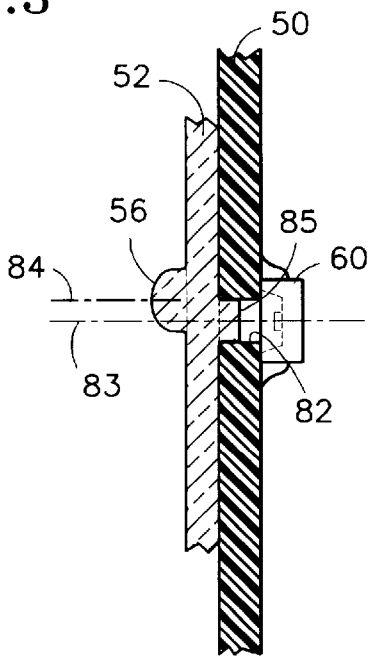
FIG. 3 is a schematic, cross-sectional view of a circuit board and a transmitter three-dimensional lens of the transmitter stack of FIG. 2 taken along the line 3—3.

Referring to FIG. 3, the transmitter circuit board 50 includes a circuit board opening 82. The LED 60 has a centerline 83 and is fixedly attached onto one side of the circuit board 50. The transmitter lens board 52 is disposed on the other side of the circuit board 50. The lens board 52 is molded from a single piece of plastic with a plurality of lenses 56, 58 formed therein. Each transmitter three-dimensional lens 56 includes a centerline 84 which is offset from the LED centerline 83. The transmitter curtain lens 58 centerline (not shown) substantially coincides with the LED centerline 83. A tab 85 is formed on the transmitter lens board 52 to fit into the circuit board opening 82.

The detector lenses' 76, 78 structure is analogous to that of the corresponding transmitter lenses 56, 58. The centerline of the detector three-dimensional lenses 76 is offset from the centerline of the photodiode 80. In the best mode embodiment of the present invention, the optical devices are surface mounted onto the circuit board 50.

In operation, the safety system 38 prevents the cab doors 28, 30 from closing if an object or person is detected either across the threshold 34 or approaching the doorway 12. The transmitter curtain lenses 58 emit a signal across the threshold 34 to the detector curtain lenses 78. If the curtain signal is interrupted when the doors 28, 30 are either open or closing, the safety system 38 communicates to the door controller (not shown) to either maintain the doors open or reverse the closing operation, respectively. The strength of the curtain signal received at the detector curtain lenses 78 is utilized to determine the distance between the closing doors 28, 30.

Figure 4:
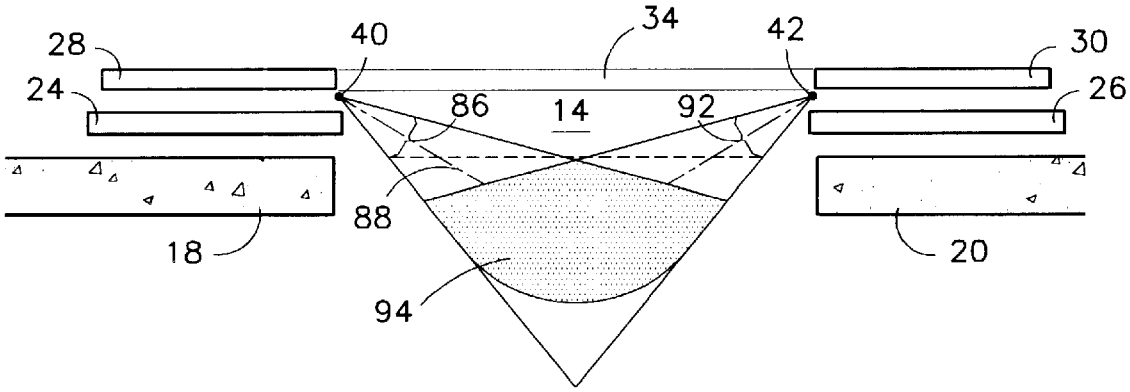
FIG. 4 is a schematic, plan view of the door system with the safety system of FIG. 1.

The transmitter three-dimensional lenses 56 emit a signal at a predetermined angle outward into the hallway 14, as shown in FIG. 4. The direction and angle of the signal are determined by the amount of the offset between the centerline 84 of the transmitter three-dimensional lens 56 and the centerline 83 of the LED 60. In the best mode of the present invention, the transmitter three-dimensional lenses 56 have a relatively narrow field of view 86 spanning approximately ten degrees (10°) and having a centerline 88 at approximately thirty degrees (30°) angle from the threshold 34 into the hallway 14. The tab 85 of the transmitter lens board 52 ensures proper positioning of the lenses 56, 58.

The detector three-dimensional lenses 76 receive a signal emitted from the transmitter three-dimensional lenses 56 and reflected from an object at a predetermined angle. The direction and angle of the received signal are determined by the amount of the offset between the centerlines of the detector three-dimensional lenses and the centerline of the photodiodes 80. In the best mode of the present invention, the detector three-dimensional lenses 76 have a relatively broader field of view 92, limited by the physical constraints of the detector stack housing 66 and the detector barrier 84.

The intersection between the field of view 86 of the transmitter three-dimensional lenses 56 and the field of view 92 of the detector three-dimensional lenses 76 defines a detection zone 94. When an object or person enters the detection zone 94, the signal from the transmitter three-dimensional lenses 56 hits the obstruction positioned within the detection zone 94 and is reflected into the detector three-dimensional lenses 76. When the detector three-dimensional lenses 76 receive a signal, the safety system 38 communicates with the door controller to either reverse the closing operation or maintain the doors 28, 30 open.

The offset lenses provide an effective and inexpensive method for angling a signal emitted or received by optical devices of the safety system. The angle of the signal can be controlled by changing the amount of the offset between the lens and the optical device. The offsetting of the lenses eliminates the need for bending optical devices and providing additional hardware to maintain the optical devices bent. The present invention also provides compact packaging and reduces space requirements for the safety system. The lens board not only ensures accuracy and uniformity in placement of lenses, but also reduces associated labor and costs.

Although the best mode of the present invention describes double sliding elevator doors, the present invention is also applicable to single sliding doors, vertical sliding doors and other similar door systems. In a single sliding door configuration, one of the stacks can be mounted on the door, whereas the second stack can be mounted on the wall across from the doorway. In a vertical door configuration, frequently used in freight elevators, stacks can be mounted horizontally.

While the present invention has been illustrated and described with respect to a particular embodiment thereof, it should be appreciated by those of ordinary skill in the art, that various modifications to this invention may be made without departing from the spirit and scope of the present invention. For example, the best mode of the present invention shows and describes a staggered pattern for the transmitter three-dimensional lenses and the detector three-dimensional lenses. However, for the purposes of the present invention, any pattern of the three-dimensional lenses is suitable. Furthermore, other energy sources can be used as transmitters.

We claim:

1. A safety system for detecting an obstruction in a hallway approaching a set of sliding doors moving along a threshold, said safety system comprising:

a plurality of transmitters emitting a signal into said hallway at a preset range of angles with respect to said threshold, each of said plurality of transmitters having a light emitting device with a light emitting device centerline and a transmitter lens with a transmitter lens centerline, said transmitter lens centerline being offset from said light emitting device centerline to emit said signal from said light emitting device into said hallway at said preset range of angles; and a plurality of detectors receiving said signal reflected from said obstruction, each of said plurality of detectors having an optical device with an optical device centerline and a detector lens with a detector lens centerline, said detector lens centerline being offset from said optical device centerline to receive said signal reflected from said obstruction at said preset range of angles.

2. The safety system according to claim 1, wherein said transmitter lens is formed within a plastic sheet fitting over a circuit board.

3. The assembly according to claim 2, wherein said plastic sheet has a tab protruding therefrom and fitting into an opening formed within said circuit board to maintain said transmitter lens in proper position.

4. The safety system according to claim 1, wherein said detector lens is formed within a plastic sheet fitting over a circuit board.

5. An assembly for transmitting a signal at an angle, said assembly comprising:

a circuit board having a circuit board opening and a first side and a second side;

an optical device attaching onto said first side of said circuit board and projecting a signal through said circuit board opening, said optical device having an optical device centerline; and a lens disposed on said second side of said circuit board, said lens being offset from said optical device centerline to angle said signal emitted from said optical device.

6. The assembly according to claim 5, wherein said lens is formed within a plastic sheet fitting over said circuit board.

7. The assembly according to claim 6, wherein said plastic sheet has a tab protruding therefrom and fitting into said circuit board opening to maintain said lens in proper position.

8. The assembly according to claim 5, wherein said optical device is surface mounted onto said circuit board.

9. An assembly comprising:

an optical device having an optical device centerline, said optical device communicating a signal; and a lens having a lens centerline, said lens centerline being offset from said optical device centerline to direct said signal at an angle to said optical device centerline and said lens centerline.

* * * * *